US012195694B2

(12) United States Patent
Yano et al.

(10) Patent No.: US 12,195,694 B2
(45) Date of Patent: Jan. 14, 2025

(54) METHOD FOR FORMING COATING FILM AND LUBRICATING OIL COMPOSITION

(71) Applicant: MITSUBISHI HEAVY INDUSTRIES, LTD., Tokyo (JP)

(72) Inventors: Akihiko Yano, Tokyo (JP); Hiroaki Takeuchi, Tokyo (JP); Shuichi Isayama, Tokyo (JP); Risako Koba, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/570,856

(22) PCT Filed: Aug. 30, 2022

(86) PCT No.: PCT/JP2022/032561
§ 371 (c)(1),
(2) Date: Dec. 15, 2023

(87) PCT Pub. No.: WO2023/037928
PCT Pub. Date: Mar. 16, 2023

(65) Prior Publication Data

US 2024/0279566 A1 Aug. 22, 2024

(30) Foreign Application Priority Data

Sep. 7, 2021 (JP) ..... 2021-145702

(51) Int. Cl.
*C10M 169/04* (2006.01)
*C10M 125/22* (2006.01)
(Continued)

(52) U.S. Cl.
CPC ..... *C10M 169/04* (2013.01); *C10M 125/22* (2013.01); *C10M 139/02* (2013.01);
(Continued)

(58) Field of Classification Search
CPC ..... C10M 169/04; C10M 125/22; C10M 139/02; C10M 141/12; C10M 2201/065;
(Continued)

(56) References Cited

U.S. PATENT DOCUMENTS 3,816,313 A * 6/1974 Szieleit ..... C07F 7/1804 556/445
4,202,780 A * 5/1980 Brendle ..... C10M 7/00 508/230

(Continued)

FOREIGN PATENT DOCUMENTS

EP 177021 A2 * 4/1986
EP 1894988 A2 * 3/2008 ..... C10M 139/02

(Continued)

OTHER PUBLICATIONS

International Search Report issued in counterpart International application No. PCT/JP2022/032561, dated Nov. 22, 2022 (10 pages).

(Continued)

*Primary Examiner* — Cephia D Toomer
(74) *Attorney, Agent, or Firm* — Osha Bergman Watanabe & Burton LLP

(57) ABSTRACT

A method for forming a coating film on a sliding surface of a sliding member includes: a first contact step of supplying a lubricant composition containing tungsten disulfide to the sliding surface to bring the tungsten disulfide into contact with the sliding surface; and a second contact step of bringing a silane compound that is dialkoxysilane, trialkoxysilane, tetraalkoxysilane, or a polymer or a copolymer of dialkoxysilane, trialkoxysilane, and tetraalkoxysilane into contact with the sliding surface.

2 Claims, 10 Drawing Sheets

(51) Int. Cl.
*C10M 139/02* (2006.01)
*C10M 141/12* (2006.01)
*C10N 50/00* (2006.01)

(52) U.S. Cl.
CPC .... *C10M 141/12* (2013.01); *C10M 2201/065* (2013.01); *C10M 2203/003* (2013.01); *C10M 2227/02* (2013.01); *C10N 2050/023* (2020.05)

(58) Field of Classification Search
CPC ..... C10M 2203/003; C10M 2227/02; C10M 2227/04; C10N 2050/023; C10N 2030/02
See application file for complete search history.

(56) References Cited

U.S. PATENT DOCUMENTS

| | | | |
|---|---|---|---|
| 2008/0058231 | A1 | 3/2008 | Yamaguchi et al. |
| 2008/0058232 | A1 | 3/2008 | Yamaguchi et al. |
| 2014/0179569 | A1 | 6/2014 | Bill |
| 2016/0075965 | A1 | 3/2016 | Bouffet |
| 2017/0073612 | A1 | 3/2017 | Thiebaut et al. |

FOREIGN PATENT DOCUMENTS

| | | | |
|---|---|---|---|
| JP | 2008056929 | A | 3/2008 |
| JP | 2008056930 | A | 3/2008 |
| JP | 2010024318 | A | 2/2010 |
| JP | 2016515663 | A | 5/2016 |
| JP | 2017506694 | A | 3/2017 |
| JP | 6236593 | B1 | 11/2017 |
| JP | 2020164595 | A | 10/2020 |

OTHER PUBLICATIONS

International Preliminary Report on Patentability issued in counterpart International application No. PCT/JP2022/032561, dated Mar. 21, 2024 (11 pages).

* cited by examiner

METHOD FOR FORMING COATING FILM AND LUBRICATING OIL COMPOSITION

TECHNICAL FIELD

The present disclosure relates to a method for forming a coating film that is applied to a sliding member and a lubricant composition.

The present application claims the benefit of priority based on Japanese Patent Application No. 2021-145702 filed on Sep. 7, 2021, the content of which is incorporated herein by reference.

BACKGROUND ART

A machine element such as a rolling bearing or a gear includes a sliding member that receives a repeated load. A sliding surface formed on the sliding member is in a lubricated state of rolling and sliding, and has a limited fatigue life under a surface pressure condition where the sliding surface receives a repeated load and exceeds the fatigue limit. The design life is set in consideration of a safety factor in addition to the limited fatigue life. However, for example, when the lubricated state of the member is poor, a scratch is formed on the sliding surface due to foreign matter, rust is formed, or a higher load than expected is applied, damage may occur during a period where the fatigue life is shorter than the set fatigue life. When damage such as surface roughening, cracking, or delamination occurs on the sliding surface, operation failure occurs or the damage propagates to cause flaking such that the member needs to be replaced.

When the damage occurs on the sliding surface, as a countermeasure for suppressing flaking without replacing the member, for example, replacement of a lubricant, removal of wear dust or delaminated pieces by flushing, or a method of limiting operating conditions is considered.

The present inventors disclose a method of suppressing propagation of damage by forming a coating film on a sliding surface by reaction of a silane compound using a surface protection oil containing a lubricant and the silane compound and covering a damaged location with this coating film (PTL 1).

CITATION LIST

Patent Literature

[PTL 1] Japanese Unexamined Patent Application Publication No. 2020-164595

SUMMARY OF INVENTION

Technical Problem

The method described in PTL 1 has an advantageous effect in that the propagation of damage can be suppressed with a simple method, but is required to further improve the suppression effect.

The present disclosure has been made in consideration of the above-described circumstances, and an object thereof is to further improve an effect of suppressing propagation of damage occurring on a sliding surface of a sliding member.

Solution to Problem

In order to achieve the above-described object, one aspect of a method for forming a coating film according to the present disclosure is a method for forming a coating film on a sliding surface of a sliding member, the method including: a first contact step of supplying a lubricant composition containing tungsten disulfide to the sliding surface to bring the tungsten disulfide into contact with the sliding surface; and a second contact step of bringing a silane compound that is dialkoxysilane, trialkoxysilane, tetraalkoxysilane, or a polymer or a copolymer thereof into contact with the sliding surface.

In addition, one aspect of a lubricant composition according to the present disclosure is a lubricant composition including a lubricating base oil, tungsten disulfide, and a silane compound that is dialkoxysilane, trialkoxysilane, tetraalkoxysilane, or a polymer or a copolymer thereof, in which a concentration of the tungsten disulfide in the lubricant composition is 0.01 to 5 mass %, and a mass ratio of the silane compound to the tungsten disulfide is 0.3 to 0.5.

Advantageous Effects of Invention

In the aspect of the method for forming a coating film according to the present disclosure, the coating film that covers the sliding surface of the sliding member is formed. Therefore, the occurrence of a crack in the sliding surface can be suppressed. In addition, even when a crack is formed on the sliding surface, the propagation of the crack can be suppressed, and the flaking life can be extended.

In addition, by forming the coating film on the sliding surface using the aspect of the lubricant composition according to the present disclosure, the occurrence of a crack in the sliding surface and the propagation of the crack can be suppressed, and thus the flaking life can be extended.

DESCRIPTION OF EMBODIMENTS

Figure 1:
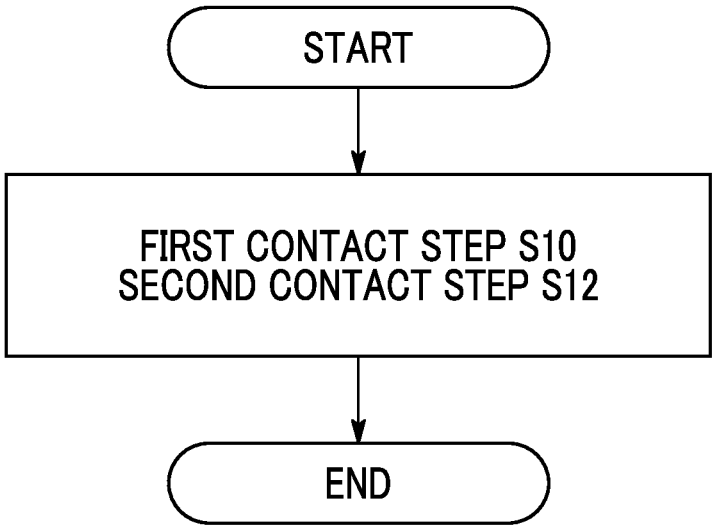
FIG. 1 is a process drawing illustrating a method for forming a coating film according to one embodiment.

Hereinafter, some embodiments of the present invention will be described with reference to the accompanying drawings. Note that dimensions, materials, shapes, relative arrangements, and the like of components described in the embodiments or illustrated in the drawings are not intended to limit the scope of the present invention, but are merely exemplary.

For example, an expression representing a relative or absolute arrangement such as "in a certain direction", "along a certain direction", "parallel", "orthogonal", "center", "concentric", or "coaxial" does not strictly represent only the arrangement, but also a tolerance or a state of being relatively displaced with an angle or a distance to the extent that the same function can be obtained.

For example, an expression such as "identical", "equal", or "homogeneous" representing a state where things are equal to each other does not strictly represent only the equal state, but also a tolerance or a state where there is a difference to the extent that the same function can be obtained.

For example, an expression representing a shape such as a quadrangular shape or a cylindrical shape does not represent only a shape such as a quadrangular shape or a cylindrical shape in a geometrically strict sense, but also a shape including an uneven portion, a chamfered portion, and the like within a range in which the same effect can be obtained.

On the other hand, the expressions "being provided with", "comprising", "including", or "having" one component are not exclusive expressions excluding the presence of other components.

Figure 12A:
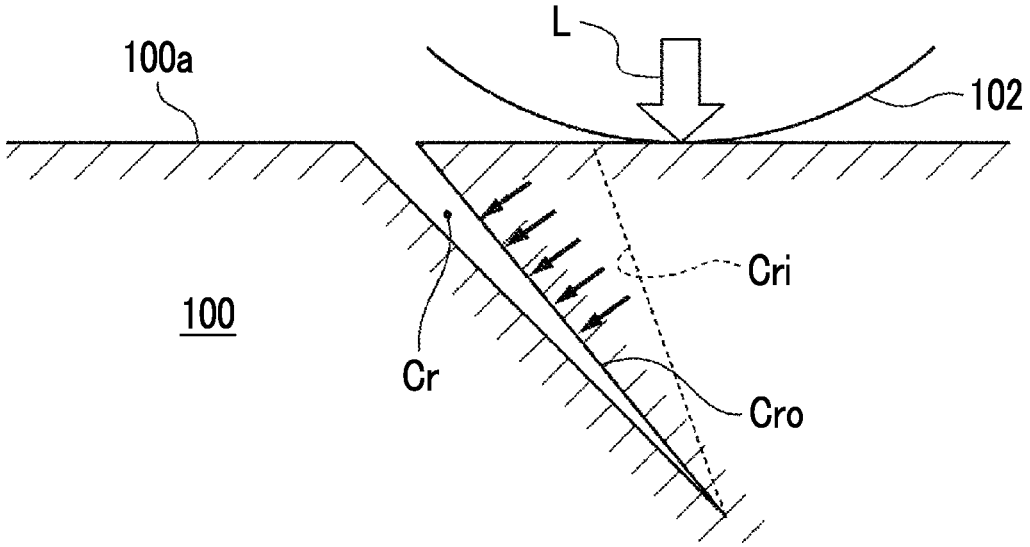
FIG. 12A is a schematic cross-sectional view illustrating behavior of a crack peripheral region when an additive does not enter a crack in Comparative Example.
Figure 12B:
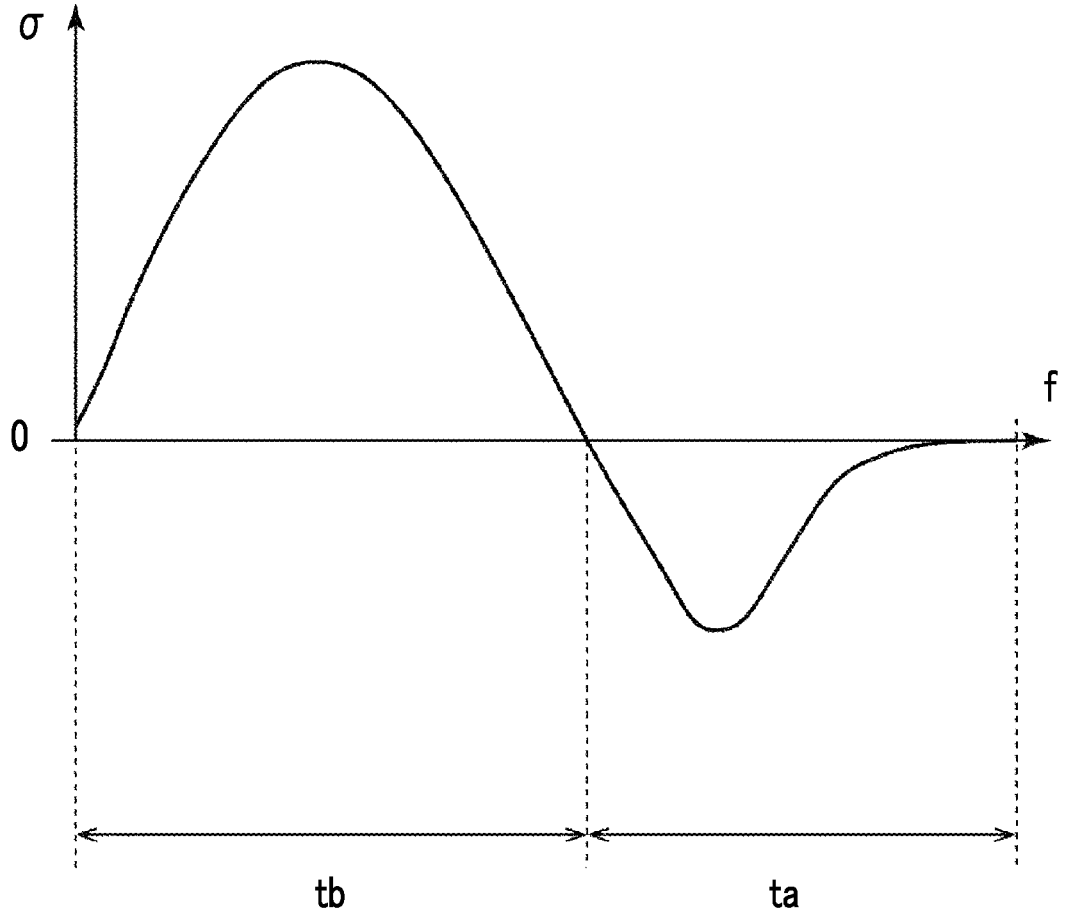
FIG. 12B is a line diagram illustrating a stress amplitude that occurs in the crack peripheral region when the additive does not enter the crack in Comparative Example.

FIG. 12A is a schematic cross-sectional view illustrating a sliding member 100 that receives a repeated load in a machine element such as a rolling bearing or a gear. A sliding surface 100*a* of the sliding member 100 illustrated in FIG. 12A is the sliding surface 100*a* in the related art to which a method for forming a coating film according to the present disclosure is not applied, and is in a state where a repeated load L is received from a counterpart sliding member 102 to form a crack Cr. FIG. 12B is a line diagram illustrating an amplitude of a repeated stress σ that occurs in a crack peripheral region due to the repeated load L received from the counterpart sliding member 102. When the machine element is a rolling bearing, for example, the sliding member 100 is a raceway ring (inner ring, outer ring), and the counterpart sliding member 102 is a rolling element.

In the sliding surface 100*a* in the related art illustrated in FIG. 12A, the counterpart sliding member 102 slides and passes through an opening of the crack Cr. As a result, a high oil film pressure is generated in the crack Cr, and the crack peripheral region receives the high repeated load L. In the same drawing, a broken line Cri indicates a position of the crack Cr before the sliding surface 100*a* receives the load from the counterpart sliding member 102. The crack Cr is elastically deformed up to a position of a solid line Cro due to the load received from the counterpart sliding member 102.

In FIG. 12B, the horizontal axis represents the time, tb represents a period of time where the counterpart sliding member 102 is passing through the crack Cr, and ta represents a period of time after the counterpart sliding member 102 passed the crack Cr. The counterpart sliding member 102 passes through the opening of the crack Cr, and the crack peripheral region is elastically deformed such that the repeated stress σ having a large amplitude occurs in the crack peripheral region of the sliding member 100. The propagation rate of the crack Cr may be fast depending on the repeated stress σ.

Figure 2:
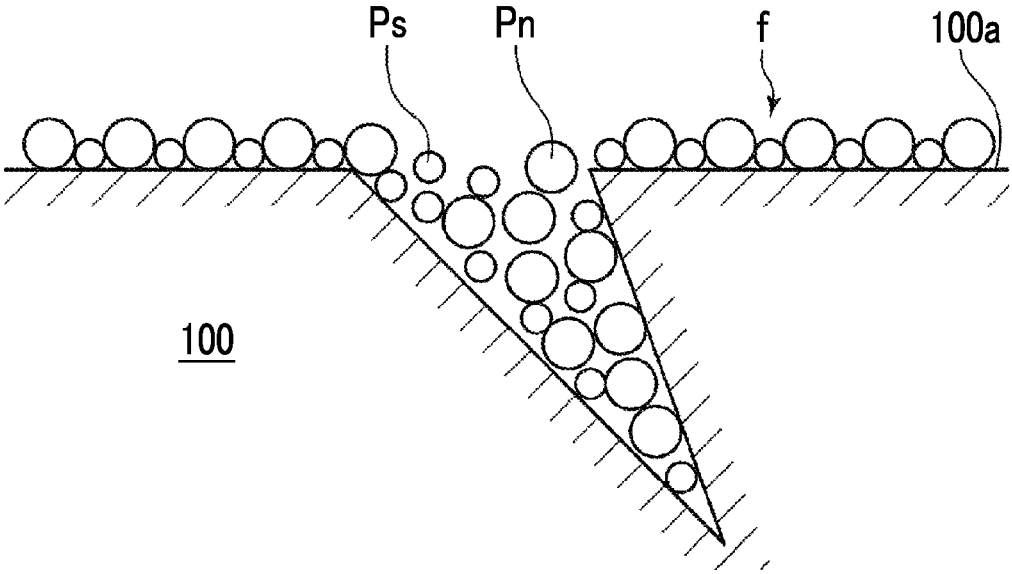
FIG. 2 is a schematic cross-sectional view illustrating a cross-section of a sliding member on which a coating film is formed using the method for forming a coating film.

FIG. 1 is a process drawing illustrating one embodiment of the method for forming a coating film according to the present disclosure, and FIG. 2 is a schematic cross-sectional view illustrating the sliding surface 100*a* of the sliding member 100 to which the method for forming a coating film is applied.

In FIG. 1, in a first contact step S10, a lubricant composition where a lubricating base oil contains at least tungsten disulfide is supplied to the sliding surface 100*a*. As a result, the tungsten disulfide is brought into contact with the sliding surface 100*a*. In addition, in a second contact step S12, a silane compound that is dialkoxysilane, trialkoxysilane, tetraalkoxysilane, or a polymer or a copolymer thereof is brought into contact with the sliding surface 100*a*.

As a result, as illustrated in FIG. 2, a component in the silane compound and the lubricant composition and a component forming the sliding surface 100*a* react with each other to form a coating film f containing tungsten disulfide on the sliding member 100. Due to the coating film f, the sliding surface 100*a* can be protected, and the damage of the sliding surface 100*a* can be suppressed. In addition, even when initial damage occurs in the sliding surface 100*a*, particles of tungsten disulfide having a large diameter, a high density, and a high hardness enter the crack Cr formed by the initial damage, the tungsten disulfide particles in the crack Cr can suppress the action of an oil film pressure in the crack, the oil film pressure being generated by the counterpart sliding member 102 passing through the opening of the crack Cr. In addition, the elastic deformation of the crack peripheral region that occurs due to the repeated load L applied from the counterpart sliding member 102 can be suppressed. As a result, the stress amplitude σ that occurs in the crack peripheral region can be reduced. In addition, the silane compound forms the coating film f and functions as an adhesive agent that bonds the particles to each other and allows the particles to remain in the crack Cr. Due to the integrated effect of the two kinds of additive, the flaking life from the initial damage to flaking can be extended.

In one embodiment, the tungsten disulfide and the silane compound are formed of nanoparticles having a particle size of less than 1 μm. The nanoparticles have a particle size, for example, 1 to several hundreds of nanometers. This way, since the particle size is small, the nanoparticles are likely to enter the crack Cr, and the filling factor in the crack Cr can be improved.

The particle size of the nanoparticles of the silane compound is less than the particle size of the nanoparticles of the tungsten disulfide. Therefore, in the crack Cr, the nanoparticles of the tungsten disulfide having a large particle size are easily surrounded by the nanoparticles of the silane compound having a smaller particle size, and thus the binder effect of the silane compound can be improved.

In FIG. 2, particles having a larger particle size are nanoparticles Pn of the tungsten disulfide, and particles having a smaller particle size than the nanoparticles Pn are nanoparticles Ps of the silane compound. For example, the particle size of the nanoparticles Pn is about 100 times the particle size of the nanoparticles Ps of the silane compound.

Figure 3A:
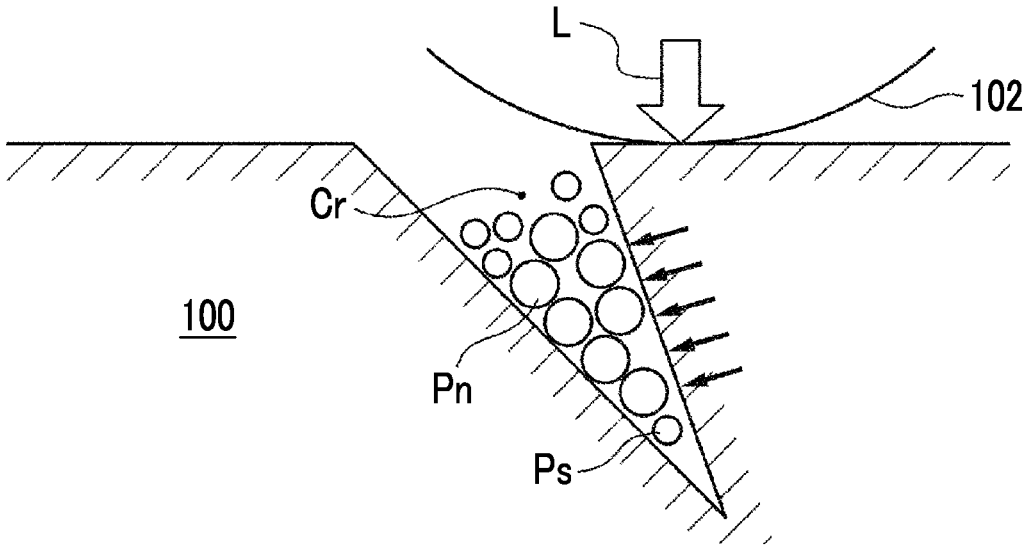
FIG. 3A is a schematic cross-sectional view illustrating behavior of a crack when an additive enters the crack formed on a sliding surface using the method for forming a coating film.
Figure 3B:
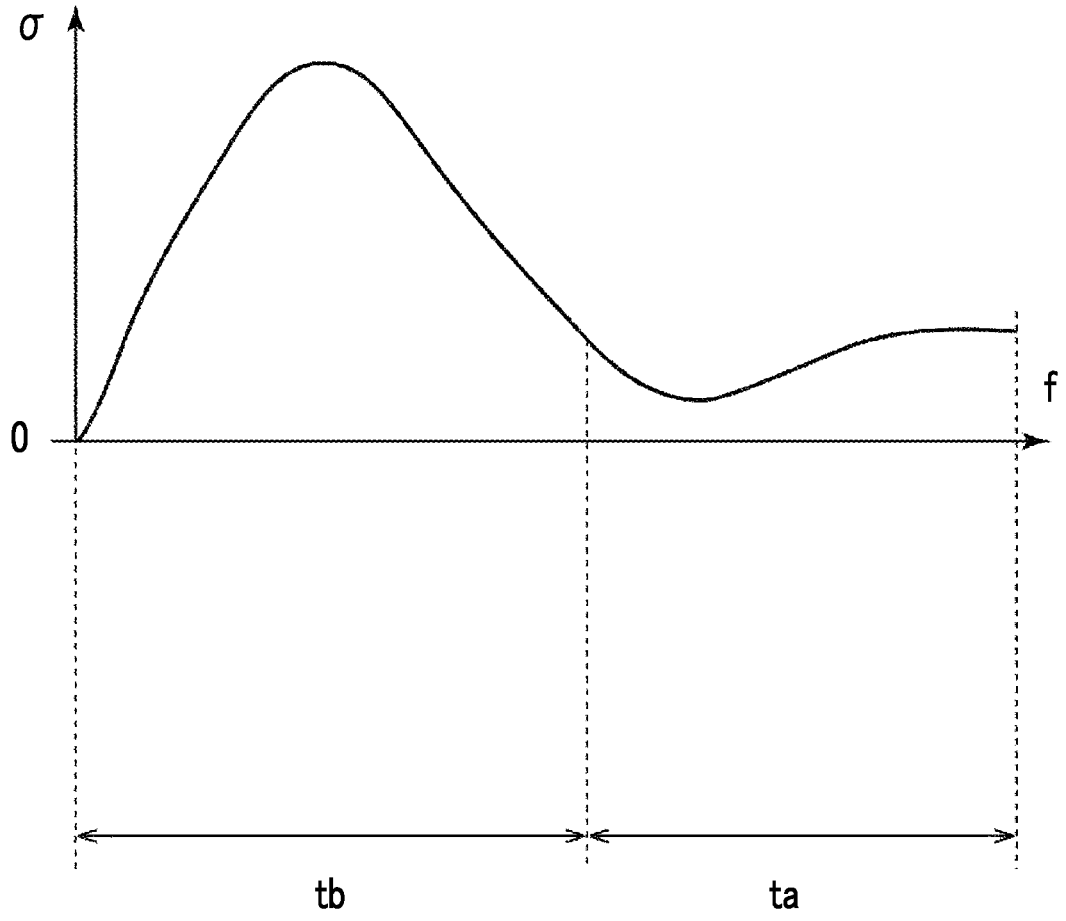
FIG. 3B is a line diagram illustrating a stress amplitude that occurs in the periphery of the crack when the additive enters the crack formed on the sliding surface using the method for forming a coating film.

FIG. 3A is a schematic cross-sectional view illustrating behavior of the crack Cr when the nanoparticles Pn and Ps enter the crack Cr in the above-described embodiment. In the peripheral region of the crack Cr where the nanoparticles Pn and Ps enter, the large elastic deformation illustrated in FIG. 12A is suppressed. FIG. 3B illustrates the stress amplitude σ that occurs in the peripheral region of the crack Cr illustrated in FIG. 3A. In the embodiment illustrated in FIGS. 3A and 3B, the elastic deformation of the crack Cr is suppressed, and the stress amplitude σ that occurs in the crack peripheral region is also reduced as compared to when the coating film f is not formed and the particles of the tungsten disulfide of the silane compound do not enter the crack Cr as illustrated in FIGS. 12A and 12B.

The lubricating base oil in the lubricant composition is an oil, and examples thereof include mineral oil, polyalphaolefin, and polyolester. In addition, the viscosity grade is preferably VG32 to VG680.

As the silane compound, as described above, dialkoxysilane, trialkoxysilane, tetraalkoxysilane, or a polymer or a copolymer thereof is used. When the silane compound is a polymer or a copolymer, the number of monomers is preferably 5 or less. Two or more alkoxy groups in the silane compound may be the same as or different from each other. The number of carbon atoms in the alkoxy group is preferably 1 to 3. When the silane compound is dialkoxysilane or trialkoxysilane, not only the alkoxy groups but also one or two hydrogen atoms or any functional group are bonded to a silicon atom of the silane compound.

Hereinafter, a mechanism in which the coating film f is formed on the sliding surface 100*a* by reaction of the silane compound and the component forming the sliding surface 100*a* will be described. Here, a case where tetraethoxysilane ($(C_2H_5O)_4Si$) is used as the silane compound will be described. The coating film f is formed on the sliding surface 100*a* by hydrolyzing and condensing the silane compound in the lubricant composition in a state where the lubricant composition is brought into contact with the sliding surface 100*a*.

Figure 4:
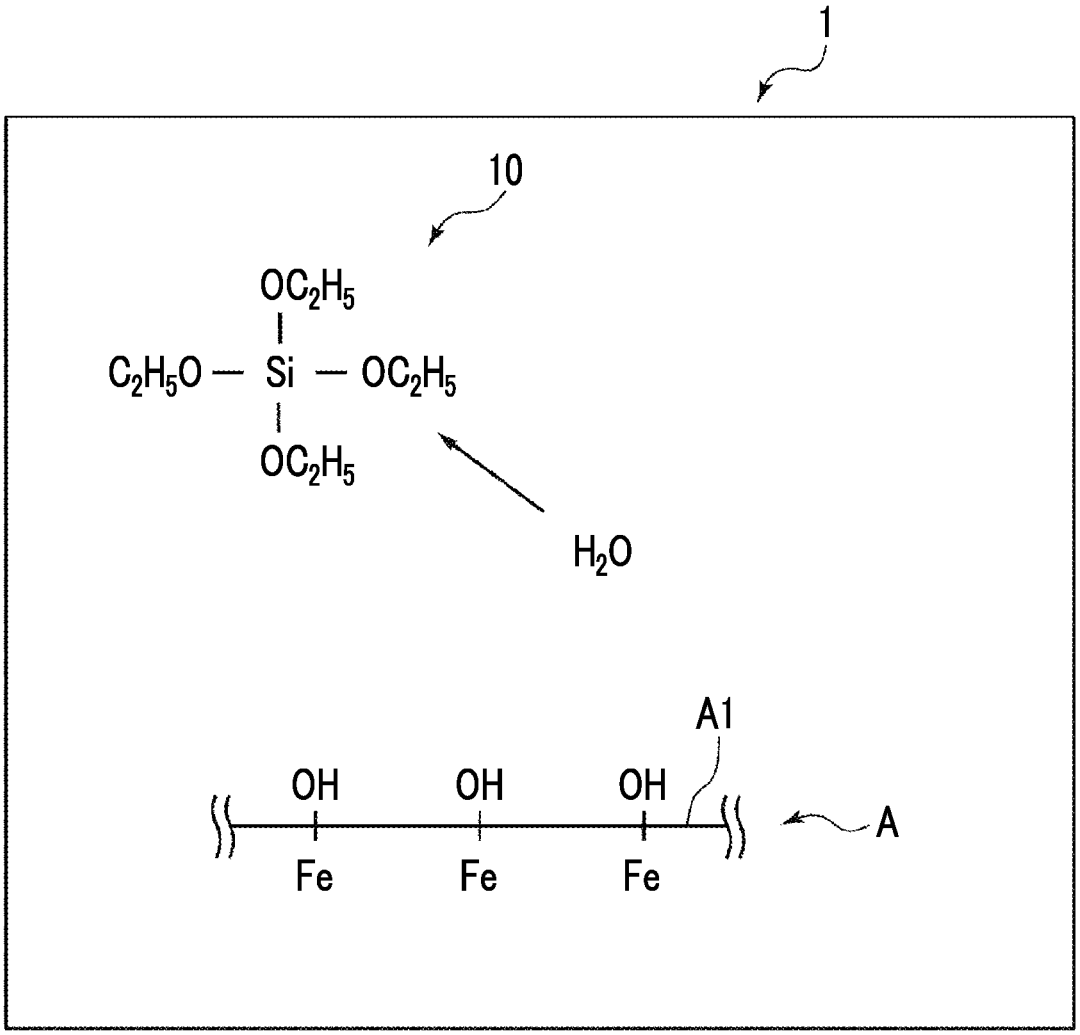
FIG. 4 is a schematic diagram illustrating a reaction of forming a coating film on the sliding surface in a method for forming a coating film according to one embodiment.
Figure 5:
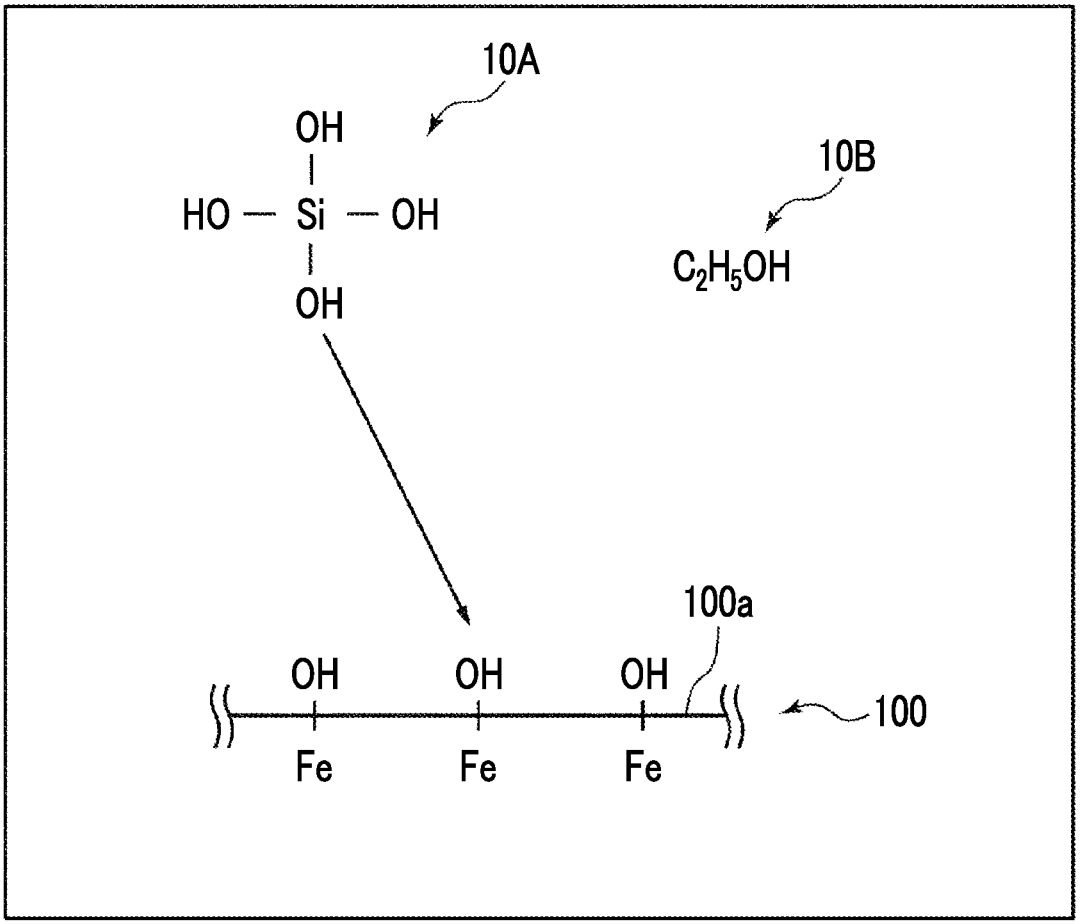
FIG. 5 is a schematic diagram illustrating the reaction of forming the coating film on the sliding surface in the method for forming a coating film according to the embodiment.

That is, as illustrated in FIG. 4, a lubricant composition 1 contains a silane compound 10 (here, tetraethoxysilane ($(C_2H_5O)_4Si$)) and water ($H_2O$). The water is water in the lubricant composition 1 or water added as impurity. The silane compound 10 reacts with water to be hydrolyzed. As illustrated in FIG. 5, the silane compound 10 is decomposed into a first material 10A and a second material 10B due to the hydrolysis. The first material 10A contains Si and OH, and is a material where an Si group and an OH group are bonded to each other. The first material 10A is tetrasilanol ($Si(OH)_4$). The second material 10B is a material (organic matter) obtained by removing the first material 10A from the silane compound 10 and water, and is ethanol ($C_2H_5OH$). For convenience of description, FIGS. 4 and 5 illustrate only the single silane compound 10 and single water. However, actually, a plurality of the silane compounds 10 and a plurality of water components are present.

Figure 6:
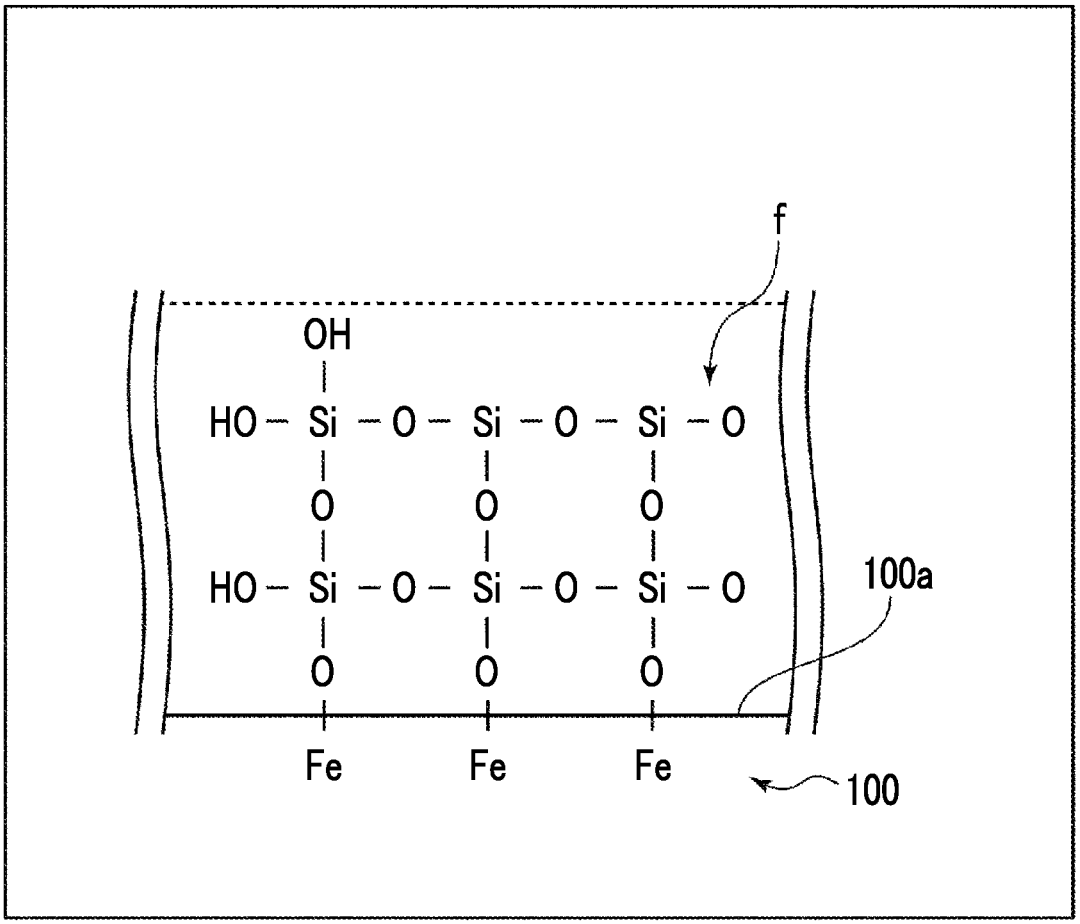
FIG. 6 is a schematic diagram illustrating the reaction of forming the coating film on the sliding surface in the method for forming a coating film according to the embodiment.

Here, as illustrated in FIGS. 4 and 5, the sliding member 100 is terminated with an OH group. That is, since the sliding surface 100*a* is a metal oxide (here, an oxide such as $Fe_2O_3$ or $Fe_3O_4$), the sliding member 100 is terminated with an OH group. In other words, an OH group is present in the sliding surface 100*a* of the sliding member 100. The first material 10A, here, tetrasilanol is an unstable material and is easily reactive. Accordingly, the first material 10A reacts with the OH group of the sliding surface 100*a* and is condensed, here, dehydrated and condensed such that a siloxane bond (bond between a Si group and an O group) is formed as illustrated in FIG. 6. That is, the OH group bonded to the Si group in the first material 10A is dehydrated and condensed such that the Si group is bonded to Fe in the sliding member 100 through the O group. Accordingly, the coating film f containing Si and O is formed on the sliding surface 100*a* of the sliding member 100.

In addition, the first material 10A is also dehydrated and condensed with another first material 10A. In other words, the hydrolyzed silane compounds 10 are also dehydrated and condensed. That is, the Si group of the first material 10A is also bonded to the Si group of another first material 10A through the O group. Accordingly, the coating film f is formed to contain a plurality of bonds between an Si group and an O group and has a configuration in which the Si group is bonded to Fe of a member A through the O group and the Si groups are bonded to each other through the O group. Accordingly, the coating film f can be formed as a thick film. The configuration (chemical composition) of the coating film f in FIG. 6 is exemplary and, for example, a Si group may be further bonded.

Figure 7:
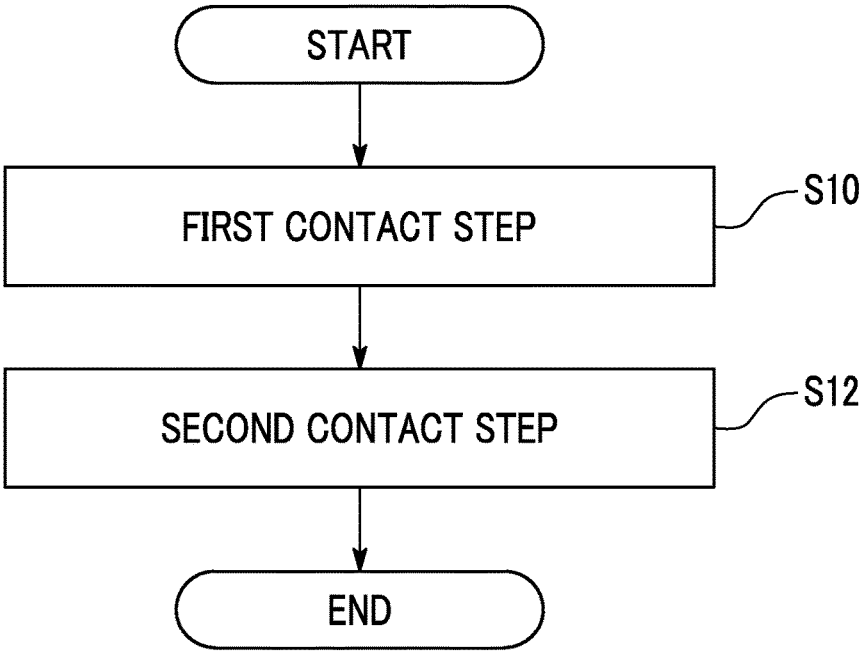
FIG. 7 is a process drawing illustrating a method for forming a coating film according to one embodiment.

In one embodiment, as illustrated in FIG. 7, the second contact step S12 is executed after the first contact step S10, and the lubricant composition used in the first contact step S10 does not contain the silane compound.

In the embodiment, the second contact step S12 of bringing the silane compound into contact with the sliding surface 100*a* is executed after the first contact step S10 of bringing the tungsten disulfide into contact with the sliding surface 100*a*. Therefore, the tungsten disulfide is brought into contact with the sliding surface 100*a* before the silane compound. Accordingly, the particles of the tungsten disulfide having a large particle size, a high density, and a high hardness can enter the crack Cr without being interfered with the particles of the silane compound. Accordingly, as illustrated in FIG. 2, a sufficient amount of the tungsten disulfide particles enter the crack Cr such that an oil film pressure generated by the counterpart sliding member 102 such as a rolling element passing through the crack Cr can be prevented from acting in the crack. In addition, the elastic deformation of the crack peripheral region can be suppressed, and thus the stress amplitude o occurring in the crack peripheral region can be reduced. As a result, the effect of suppressing the propagation of the crack Cr can be improved, and the flaking life of the sliding member 100 can be significantly extended.

In Examples described below, Test 3 corresponds to the present embodiment.

In the present embodiment, in the second contact step S12 of bringing the silane compound into contact with the sliding surface 100*a*, the silane compound may be brought into contact with the sliding surface 100*a* directly, for example, using means such as application without being mixed with the lubricating base oil.

In addition, in another method, a first lubricating base oil containing tungsten disulfide and a second lubricating base oil containing the silane compound may be separately prepared, and the second lubricating base oil may be supplied to the sliding surface 100*a* in the second contact step S12.

Figure 8:
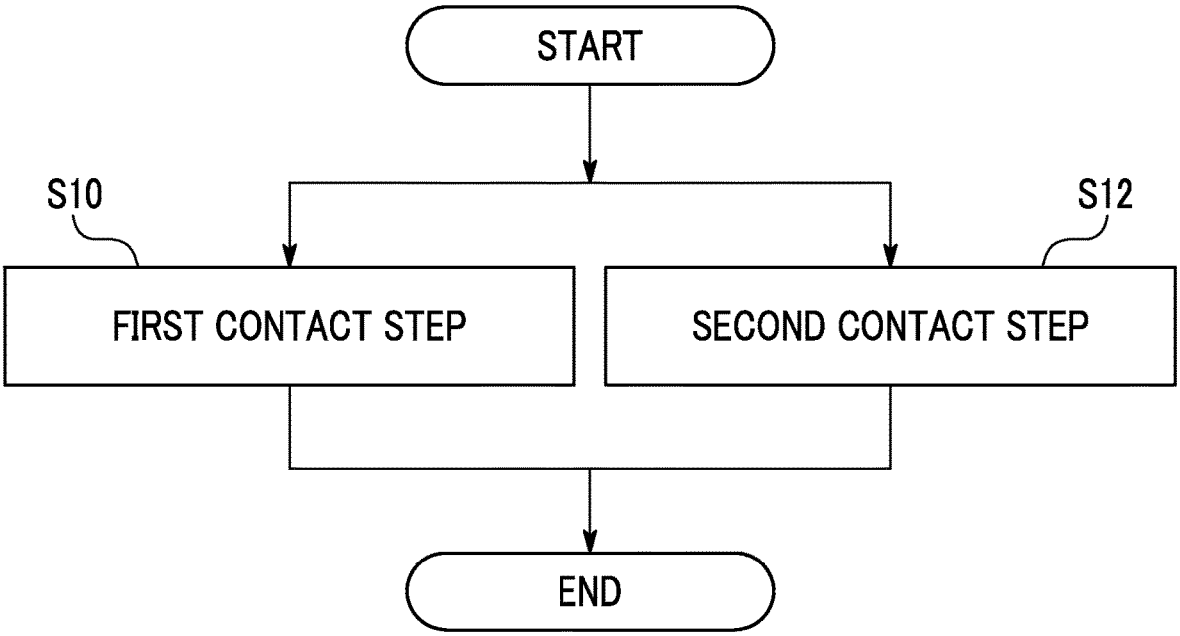
FIG. 8 is a process drawing illustrating a method for forming a coating film according to one embodiment.

FIG. 8 is a process drawing illustrating a method for forming a coating film according to another embodiment. In the embodiment, the lubricant composition is added to the tungsten disulfide and contains the silane compound, and the first contact step S10 and the second contact step S12 are simultaneously executed as illustrated in FIG. 8.

In the embodiment, by executing the first contact step S10 and the second contact step S12 simultaneously, the tungsten disulfide and the silane compound are brought into contact with the sliding surface 100*a* simultaneously. Therefore, the method for forming a coating film can be executed in one step.

In Examples described below, Test 2 corresponds to the present embodiment.

A lubricant composition according to one embodiment contains a lubricating base oil, tungsten disulfide, and a silane compound that is dialkoxysilane, trialkoxysilane, tetraalkoxysilane, or a polymer or a copolymer thereof, in which a concentration of the tungsten disulfide in the lubricant composition is 0.01 to 5 mass %, and a mass ratio of the silane compound to the tungsten disulfide is 0.3 to 0.5.

Regarding the concentration of the tungsten disulfide, it is considered that, unless the tungsten disulfide with a certain degree of concentration is present in the lubricant composition, the above-described effects cannot be obtained. Therefore, 0.01 mass % is set as a minimum concentration with reference to the concentration of a general lubricant composition. On the other hand, as the concentration of the tungsten disulfide in the lubricant composition increases, the risk that precipitation or clogging of a lubricant filter occurs increases. Therefore, 5 mass % is set as a maximum concentration.

It is considered that the concentration of the silane compound depends on the concentration of the tungsten disulfide in the lubricant composition in consideration of the fact that the function of the silane compound in the lubricant composition is the binder effect of bonding the particles of the tungsten disulfide to each other. Based on this, the mass ratio of the silane compound to the tungsten disulfide is estimated as follows.

For example, the concentration of the tungsten disulfide in the lubricant composition is 2 mass %. Since the density of the tungsten disulfide is 7.5 g/cm$^3$, the volume of 2 g of the tungsten disulfide is 0.26 cm$^3$. Assuming that the average particle size of the tungsten disulfide particles is 0.2 μm, the number of 2 g of the tungsten disulfide particles is $6.2\times10^{13}$. The total surface area of the number of the tungsten disulfide particle is $7.8\times10^4$ cm$^2$. Assuming that at least 0.1 μm of the silane compound is required on the surface of the tungsten disulfide particles for the adhesion of the tungsten disulfide particles, the required volume of the silane compound is $7.8\times10^4$ cm$^2\times0.00001$ cm (0.1 μm)=0.78 cm$^3$. Since the density of the silane compound is about 1 g/cm$^3$, the concentration of the silane compound required for 2 mass % of the tungsten disulfide is 0.78 mass %. Accordingly, the mass ratio of the silane compound to the tungsten disulfide is 0.78=2=0.39. It was estimated that the above-described effects can be obtained in a numerical range of 0.3 to 0.5 with a margin around the above-described numerical value.

In the present embodiment, by forming the coating film f on the sliding surface 100*a* using the lubricant composition containing the tungsten disulfide and the silane compound at the above-described content ratio, the sliding surface 100*a* can be protected, and the occurrence of initial damage can be suppressed. In addition, even when damage such as a crack occurs, the coating film f capable of suppressing the propagation of the damage can be formed. In addition, since the concentration of the tungsten disulfide is 5 mass % or less, there is no risk of the occurrence of the precipitation of the tungsten disulfide particles or the clogging of the lubricant filter. In Examples described below, the lubricant composition according to the present embodiment is used in Test 2.

Next, when a gear oil is used as the lubricating base oil and the tungsten disulfide and the silane compound are added to the lubricating base oil, a kinematic viscosity of the lubricant composition will be discussed. Since the kinematic viscosity of the tungsten disulfide is higher than that of the gear oil, a decrease in viscosity caused by the mixing of the tungsten disulfide does not occur. On the other hand, when the silane compound has a low viscosity and the silane compound is added to the gear oil, the kinematic viscosity may decrease.

Figure 9:
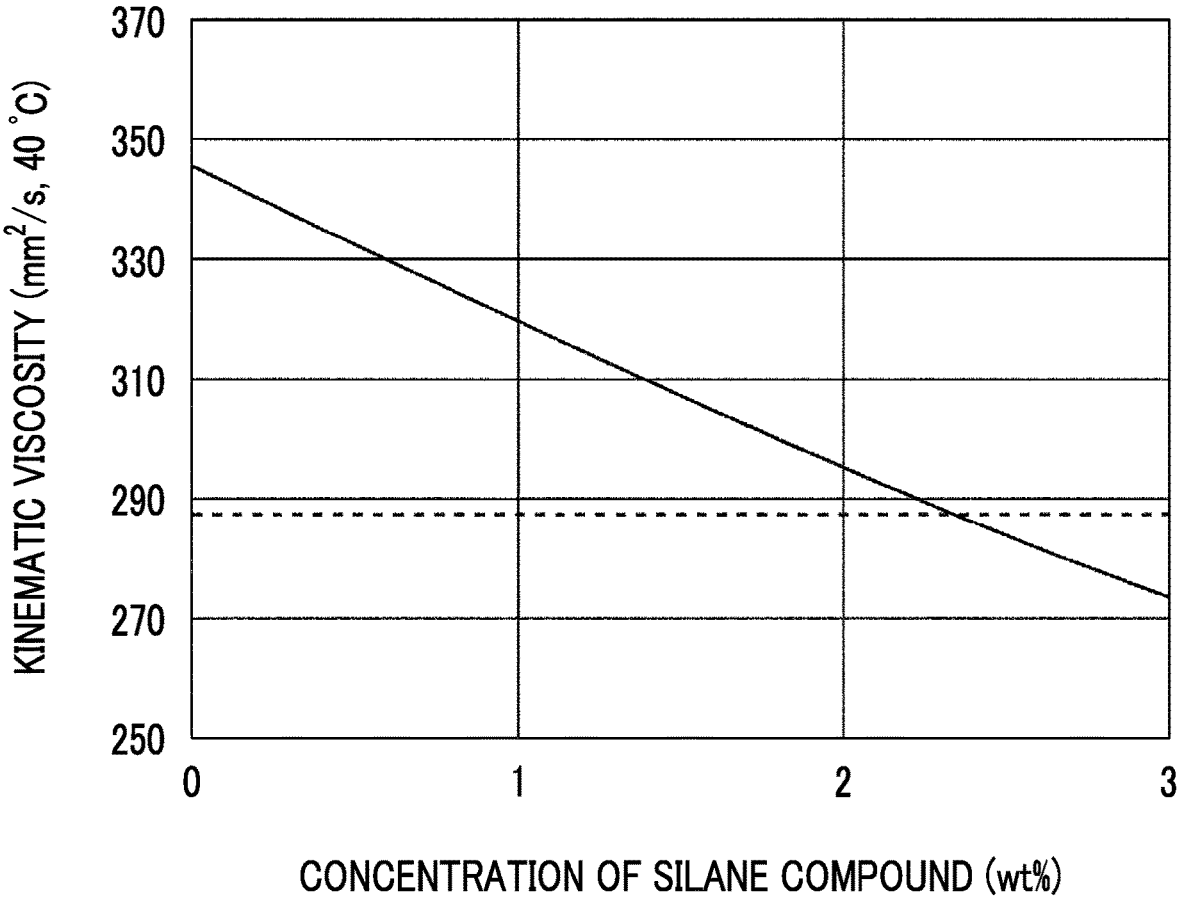
FIG. 9 is a line diagram illustrating a relationship between a concentration of a silane compound to be added to a lubricating base oil and a kinematic viscosity of a gear oil.

FIG. 9 illustrates a relationship between the concentration of the silane compound and the kinematic viscosity (40° C.) of the lubricant composition when 2 mass % of the tungsten disulfide is added to the gear oil and the silane compound is further added thereto. As the gear oil, a gear oil of VG 320 is used and has a kinematic viscosity in the standard range of ISO VG 320 (kinematic viscosity: 320 mm$^2$/s±10%). When 2.3 mass % of the silane compound is added, the viscosity decreases up to 288 mm$^2$/s (the value indicated by a broken line in FIG. 9) as the standard lower limit of ISO VG 320. Therefore, the addition amount of the silane compound needs to be 2.3 mass % at a maximum. Since the kinematic viscosity after mixing changes depending on the kind of the silane compound, the maximum concentration needs to be calculated or measured for each of the silane compounds.

During the creation of FIG. 9, a material having a kinematic viscosity shown in Table 1 below is used as the material forming the lubricant composition.

TABLE 1

| | Kinematic Viscosity (mm$^2$/s) | |
|---|---|---|
| | 40° C. | 100° C. |
| Gear Oil (Mobil SHC Gear 320 WT, manufactured by Exxon Mobil Corporation) | 343 | 44.7 |
| Tungsten Disulfide (NanoLub MP-X, manufactured by Nano Materials Inc.) | 367.8 | 29.73 |
| Silane Compound (Ethyl Silicate 40, manufactured by Colcoat Co., Ltd.) | 2.5 | 1.94 |

EXAMPLES

Next, by using a thrust roller bearing where initial damage occurred in rollers as a specimen, a test for verifying the effect of extending the life from the initial damage to flaking was executed according to the following procedure.

(a) Using an AXK 1103 thrust needle bearing, a surface pressure of 1.3 GPa was applied to the rollers such that initial damage occurred in the rollers.

(b) By using rollers where initial damage occurred as a specimen, three kinds of tests (Tests 1 to 3) were executed. As the lubricating base oil, a gear oil of VG 320 was used. Additives were nanoparticles of tungsten disulfide (2 mass %, particle size: 200 nm) and nanoparticles of a silane compound (1.4 mass %, Ethyl Silicate 40 having a particle size of 2 nm), and these two kinds of additives were added to the lubricating base oil. In Test 1, a reference test where only the lubricating base oil was used without mixing the additives was executed, and the effect of extending the flaking life obtained by mixing the additives in Test 2 and Test 3 was verified. In Test 2, the nanoparticles of the tungsten disulfide (additive A) and Ethyl Silicate 40 (additive B) were simultaneously added. In Test 3, the additive A was added first, and the additive B was added after elapse of a given period of time. The additive A and the additive B were different in particle size, and the particle size of the additive A is about 100 times that of the additive B. The reason for this is that, when the additive A and the additive B are simultaneously added, the additive B having a smaller particle size preferentially enters the crack Cr such that the filling factor of the additive A is likely to be low.

(c) A test for evaluating the life to flaking after the occurrence of initial damage in rollers was executed at a surface pressure of 21 GPa applied to the rollers.

TABLE 2

| Experiment Conditions | | | |
|---|---|---|---|
| Item | Test 1 | Test 2 | Test 3 |
| Lubricating Base Oil | Gear Oil VG 320 | Gear Oil VG 320 | Gear Oil VG 320 |
| Additive A | x | ○ | ○ |
| Additive B | x | ○ | ○ |
| Addition Timing of Additive | x | Simultaneously Added | B was Added after A |

○: Added
x: Not Added

Figure 10:
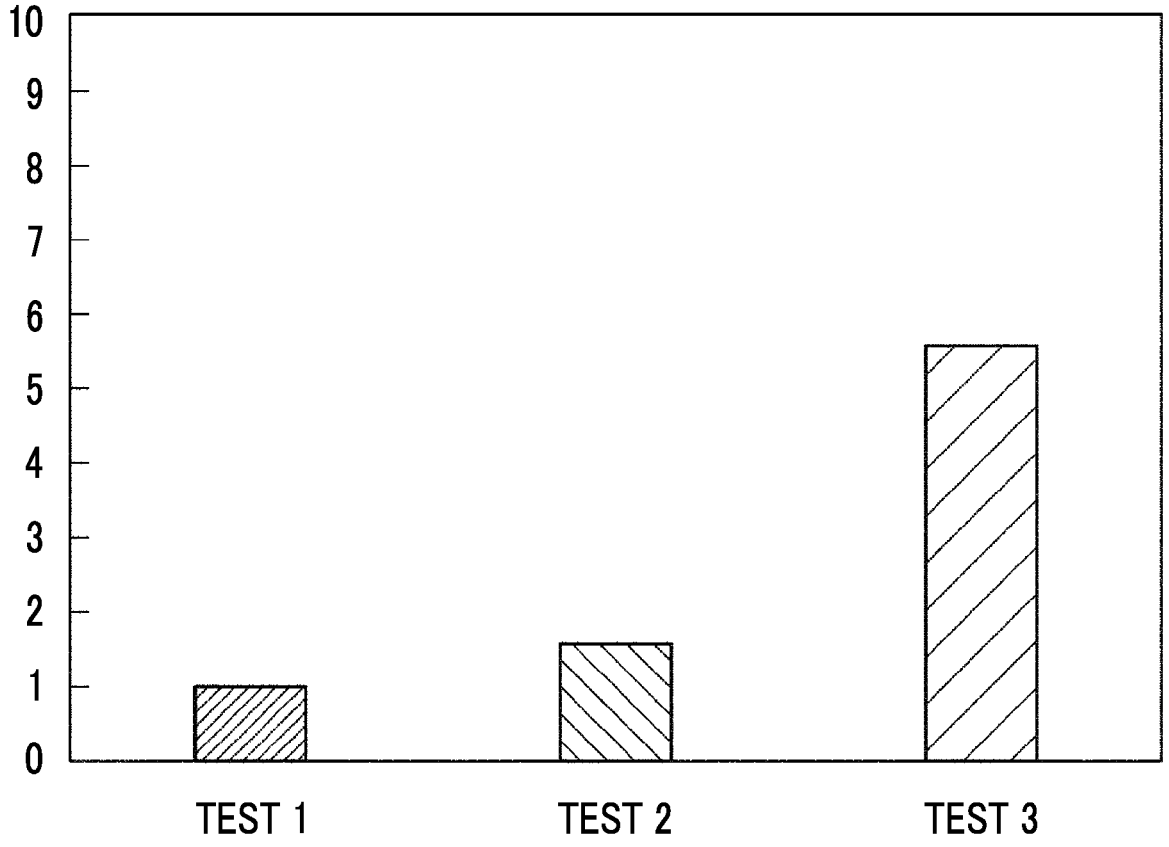
FIG. 10 is a graph illustrating a period of time until flaking occurs in each of test cases according to Comparative Example and some Examples.
Figure 11A:
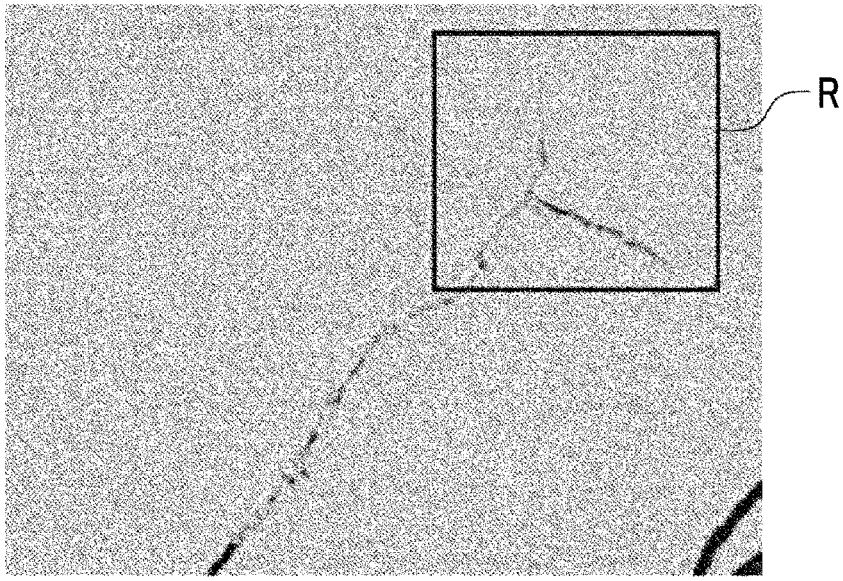
FIG. 11A is an actual image of a sliding surface where a crack is formed.
Figure 11B:
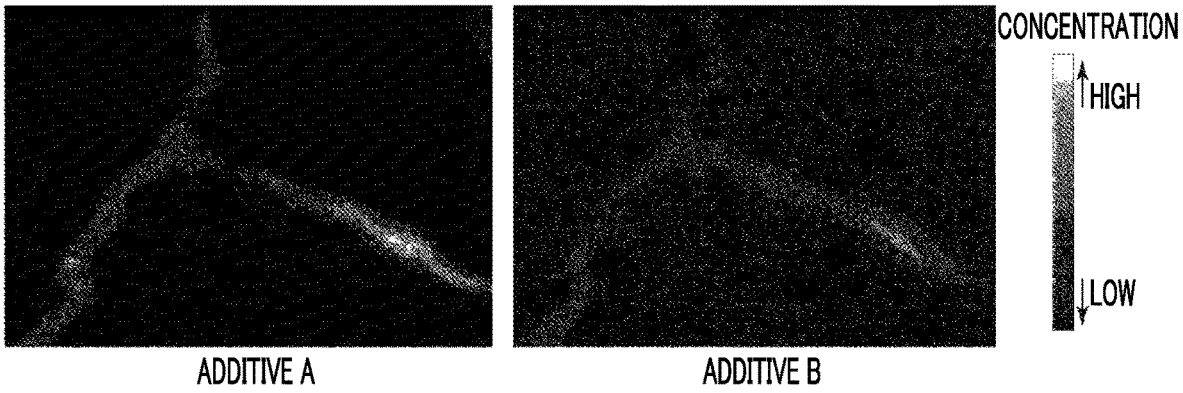
FIG. 11B is a diagram illustrating analysis results of tungsten disulfide and a silane compound in the crack.

FIG. 10 illustrates the results of calculating the life magnifications of Test 2 and Test 3 with respect to the time where flaking occurred in Test 1. The life magnifications of Tests 2 and 3 where the additives were mixed were 1.6 times and 5.6 times with respect to Test 1, respectively. In addition, as a result of comparing Test 2 and Test 3, the effect of extending the flaking life was more significant in Test 3 where there was a difference between additive mixing timings. FIGS. 11A and 11B illustrate the component analysis results in the crack after Test 3. FIG. 11A illustrates a sliding surface where a crack was formed, and FIG. 11B is a diagram illustrating the analysis results of the tungsten disulfide and the silane compound in the crack formed in a region R of the sliding surface illustrated in FIG. 11A. Since a state where the silane compound entered in the crack was shown in both of the additives A and B, the probability of the mechanism of extending the life obtained by the entrance of the additives into the crack was able to be verified. In addition, since there is a difference in the effect of extending the life by providing a difference between the additive mixing timings, it was found that the mixing timing is also a parameter relating to the effect of extending the flaking life.

The cause for the difference in the effect of extending the flaking life between Test 2 and Test 3 where the mixing timings were different is presumed to be a difference in the filling factor of the nanoparticles of the tungsten disulfide. In Test 2, the additives A and B were added at the same timing, and thus the additive B having a smaller particle size and a coarser structure than the additive A was preferentially added. Therefore, it is considered that the filling factor of the additive A is low. In Test 3, the additive A having a larger particle size was added first. Therefore, the additive A entered the crack first, and the additive B subsequently entered the crack to fill gaps of the additive A. As a result, it is considered that the density of the additives in the crack was able to be improved, and the flaking life was further able to be extended.

For example, the contents described in each embodiment are understood as follows.

1) According to one aspect, there is provided a method for forming a coating film (f) on a sliding surface (100*a*) of a sliding member (100), the method including: a first contact step (S10) of supplying a lubricant composition containing tungsten disulfide to the sliding surface (100*a*) to bring the tungsten disulfide into contact with the sliding surface (100*a*); and a second contact step (S12) of bringing a silane compound that is dialkoxysilane, trialkoxysilane, tetraalkoxysilane, or a polymer or a copolymer thereof into contact with the sliding surface.

With the above-described configuration, the particles of the tungsten disulfide enter the crack (Cr) such that the oil film pressure generated by the passage of the counterpart sliding member (102) is suppressed from acting in the crack (Cr), and the elastic deformation of the crack peripheral region is suppressed. As a result, the effect of reducing the stress amplitude (o) that occurs in the crack peripheral region is obtained. In addition, the silane compound forms the coating film (f) on the sliding surface (100*a*) and functions as an adhesive agent that bonds the particles (Pn, Ps) of the tungsten disulfide and the silane compound to each other and allows the particles to remain in the crack. Due to the integrated effect of the two kinds of additive, the flaking life from the initial damage to flaking can be extended.

2) According to the aspect, in the method for forming a coating film according to 1), the lubricant composition does not contain the silane compound, and the second contact step (S12) is executed after the first contact step (S10).

With the above-described configuration, the second contact step (S12) of bringing the silane compound into contact with the sliding surface (100*a*) is executed after the first contact step (S10) of bringing the tungsten disulfide into contact with the sliding surface (100*a*). Therefore, the tungsten disulfide is brought into contact with the sliding surface (100*a*) before the silane compound. Accordingly, the particles of the tungsten disulfide having a large particle size, a high density, and a high hardness enter the crack (Cr) without being interfered with the particles of the silane compound, the silane compound enters to fill gaps of the particles, and thus the density in the crack (Cr) can be improved. As a result, the flaking life of the sliding member (100) can be significantly extended.

3) According to another aspect, in the method for forming a coating film according to 1), the lubricant composition contains the silane compound in addition to the tungsten disulfide, and the first contact step (S10) and the second contact step (S12) are simultaneously executed.

With the above-described configuration, the first contact step (S10) of bringing the tungsten disulfide into contact with the sliding surface (100*a*) and the second contact step (S12) of bringing the silane compound into contact with the sliding surface (100*a*) are simultaneously executed. Therefore, the application of the method for forming a coating film can be simplified.

4) According to one aspect, there is provided a lubricant composition including a lubricating base oil, tungsten disulfide, and a silane compound that is dialkoxysilane, trialkoxysilane, tetraalkoxysilane, or a polymer or a copolymer thereof, in which a concentration of the tungsten disulfide in the lubricant composition is 0.01 to 5 mass %, and a mass ratio of the silane compound to the tungsten disulfide is 0.3 to 0.5.

With the above-described configuration, the lubricant composition contains the tungsten disulfide and the silane compound having the concentrations and the mass ratio in the above-described numerical ranges. Therefore, the coating film capable of exhibiting the effect of suppressing the damage propagation can be formed on the sliding surface (100*a*) using the lubricant composition. In addition, since the concentration of the tungsten disulfide is 5 mass % or less with respect to the lubricant composition, there is no risk of the occurrence of the precipitation of the tungsten disulfide particles or the clogging of the lubricant filter.

REFERENCE SIGNS LIST

1: lubricant composition
10: silane compound
100: sliding member
100*a*: sliding surface
102: counterpart sliding member
Cr (Cri, Cro): crack
L: repeated load
Pn: tungsten disulfide nanoparticles
Ps: silane compound nanoparticles
f: coating film

The invention claimed is:

1. A method for forming a coating film on a sliding surface of a sliding member, the method comprising:

a first contact step of supplying a lubricant composition containing tungsten disulfide to the sliding surface to bring the tungsten disulfide into contact with the sliding surface; and a second contact step of bringing a silane compound that is dialkoxysilane, trialkoxysilane, tetraalkoxysilane, or a polymer or a copolymer of dialkoxysilane, trialkoxysilane, and tetraalkoxysilane into contact with the sliding surface, wherein the lubricant composition does not contain the silane compound, and the second contact step is executed after the first contact step.

2. A lubricant composition comprising:

a lubricating base oil;

tungsten disulfide; and a silane compound that is dialkoxysilane, trialkoxysilane, tetraalkoxysilane, or a polymer or a copolymer thereof, wherein a concentration of the tungsten disulfide in the lubricant composition is 0.01 to 5 mass %, and a mass ratio of the silane compound to the tungsten disulfide is 0.3 to 0.5.

* * * * *